US005309602A

United States Patent [19]

Von Holten

[11] Patent Number: 5,309,602

[45] Date of Patent: May 10, 1994

[54] WALKING APPLIANCE DOOR FIXTURE AND METHOD OF USE

[76] Inventor: Hubert B. Von Holten, 345 Burnett Rd., West Lafayette, Ind. 47906

[21] Appl. No.: 971,895

[22] Filed: Nov. 4, 1992

[51] Int. Cl.[5] ..... E05B 1/00; E05B 7/00; E05F 7/00

[52] U.S. Cl. ..... 16/124; 49/461

[58] Field of Search ..... 16/124; 49/461

[56] References Cited

U.S. PATENT DOCUMENTS

| | | | |
|---|---|---|---|
| 306,188 | 10/1884 | Strong | 49/461 |
| 447,610 | 3/1891 | Hayes | 16/124 |
| 750,956 | 2/1904 | Essig | 49/461 |
| 2,063,583 | 12/1936 | Christy | 49/461 |

FOREIGN PATENT DOCUMENTS

| | | | |
|---|---|---|---|
| 828116 | 2/1938 | France | 16/124 |
| 13949 | of 1903 | United Kingdom | 16/124 |

*Primary Examiner*—John Sipos
*Assistant Examiner*—Carmine Cuda
*Attorney, Agent, or Firm*—Varnum, Riddering, Schmidt & Howlett

[57] ABSTRACT

A fixture for manipulating a door with a walking appliance of a disabled person. The walking appliance door fixture comprises a new receptacle having a cavity formed therein, an outer wall, and an appliance opening in the outer wall communicating with the cavity for passing the walking appliance therethrough and into the cavity. The outer wall has a ledge extending into the cavity and at least partially about the appliance opening of the fixture for engaging the walking appliance with the ledge when the walking appliance is positioned through the appliance opening and in the cavity. The outer wall includes a U-shaped front portion with the ledge positioned above the top thereof. The outer wall also includes a V-shaped bottom portion and a partial conically-shaped bottom portion extending between the U-shaped and V-shaped portions. A mounting flange extends from the rear of the fixture from the U-shaped and V-shaped outer wall portions for mounting the fixture to a door. The rear portion of the outer wall has a mold opening formed therein that is formed during injection molding the door fixture. The method of using the door fixture includes mounting the fixture on a door and inserting the tip of a walking aid such as a crutch or cane through the appliance opening and into the cavity of the fixture. The cane or crutch is used to push the door open or closed or to pull the door open or closed while engaging the tip of the crutch against the ledge positioned about the appliance opening of the fixture.

21 Claims, 1 Drawing Sheet

WALKING APPLIANCE DOOR FIXTURE AND METHOD OF USE

TECHNICAL FIELD

This invention relates generally to door fixtures and, in particular, to a door fixture for manipulating a door with a walking appliance such as a cane or crutch of a disabled person.

BACKGROUND OF THE INVENTION

A disabled person utilizing a walking appliance such as a cane, walker, or a pair of crutches often experiences difficulty opening and closing doors, particularly an exterior door where a gust of wind can easily catch the door and slam it against the outside wall. Hydraulic or spring-loaded door closers are a poor solution to the problem. These door closers make it extremely difficult for a disabled person with a walking appliance to open a door and keep it open while attempting to go through the door opening. The door closer continually presses the door against the person or the walking appliance, making entry difficult and frustrating. Furthermore, the door closer can easily unbalance the disabled person, which may result in injury.

Automatic door openers completely alleviate the problem by sensing the presence of a person and maintaining the door in an open position until the person has passed through the door opening. These automatic door openers are commonly found on commercial establishments. However, the cost of these automatic door openers is absolutely prohibitive for the disabled person in a personal residence, and a much more cost effective door device for opening and closing a door by a disabled person is clearly needed.

SUMMARY OF THE INVENTION

The foregoing problems and disadvantages are solved and a technical advantage is achieved by an illustrative door fixture that is mounted in or on a visible surface of the door near the unhinged side and bottom of the door. The door fixture has a receptacle for receiving the walking appliance of a disabled person, whereby the door is easily opened or closed with the walking appliance when the latter is positioned in the receptacle. The receptacle includes an outer wall with a cavity therein and an appliance opening in the outer wall communicating with the cavity for passage of the walking appliance therethrough and into the cavity. The outer wall has a ledge extending at least partially about the appliance opening and toward the cavity for engagement of the walking appliance with the ledge when the walking appliance is positioned in the receptacle. Advantageously, the disabled person can easily push open the door with the walking appliance inserted in the receptacle. The disabled person can easily pass through the opening with the walking appliance remaining in the door fixture receptacle. After passing through the door opening, the disabled person pulls on the walking appliance of which the tip engages the ledge extending about the appliance opening of the receptacle to maintain the tip of the walking appliance in the receptacle. The disabled person pulls on the walking appliance, engaging the ledge to easily close the door. When the door is closed, the tip of the walking appliance is removed from the receptacle.

This walking appliance door fixture of the present invention has a flat surface on the rear portion thereof for attachment of the receptacle to a visible surface of a door. To make installation even easier, a flange extends from about the rear portion of the outer wall of the receptacle for attachment and mounting on the door. The flange includes a number of holes formed therein for readily mounting the receptacle to a door with a number of commercially available fasteners passing through the thickness of the door. A reinforcing member extends between the outer wall and the flange about the appliance opening for reinforcing and solidifying the door fixture for extended use. The rear portion of the outer wall includes a mold opening, which communicates with the cavity of the receptacle as well as the appliance opening, for advantageously aiding in the manufacture of the door fixture. This mold opening is particularly cost effective when injection molding the door fixture or die casting the fixture with aluminum or other well-known metals.

The outer wall of the fixture resembles a cup including a U-shaped front portion extending to the flat surfaced rear portion of the fixture. This U-shaped portion forms the front and side walls of the cup. The outer wall also includes a V-shaped bottom portion and at least a partially conical portion communicating with the V-shaped bottom and U-shaped front portions. The V-shaped and at least partially conical portions form the bottom of the cup. The outer wall also includes a drain opening extending through the bottom portion of the cup for passing fluid such as rain water, which can collect therein with repeated opening and closing of the door. This advantageously prevents rain water and other fluids from collecting and damaging the surface of the door. More importantly, the bottom tip of the walking appliance is maintained in a dry condition so as to maintain stability of the appliance and the disabled person.

The outer wall comprises a plastic material or other suitable material such as aluminum, or other lightweight metallic alloys.

The method of manipulating a door with a disabled person's walking appliance comprises providing a door fixture positioned near the bottom of the door. The fixture has a receptacle with a cavity therein and an appliance opening communicating with the cavity for insertion of the walking appliance through the appliance opening and into the cavity. The method also includes providing the fixture with a ledge positioned at least partially about the appliance opening and toward the cavity for engaging the walking appliance when positioned through the appliance opening and in the cavity.

The method further includes inserting the walking appliance through the appliance opening and into the cavity and moving the door with the walking appliance when positioned in the cavity. The step of moving the door includes engaging the ledge with the walking appliance when the door is pulled with the walking appliance. This advantageously provides the disabled person a convenient and affordable fixture for opening and closing doors.

DETAILED DESCRIPTION

Figure 1:
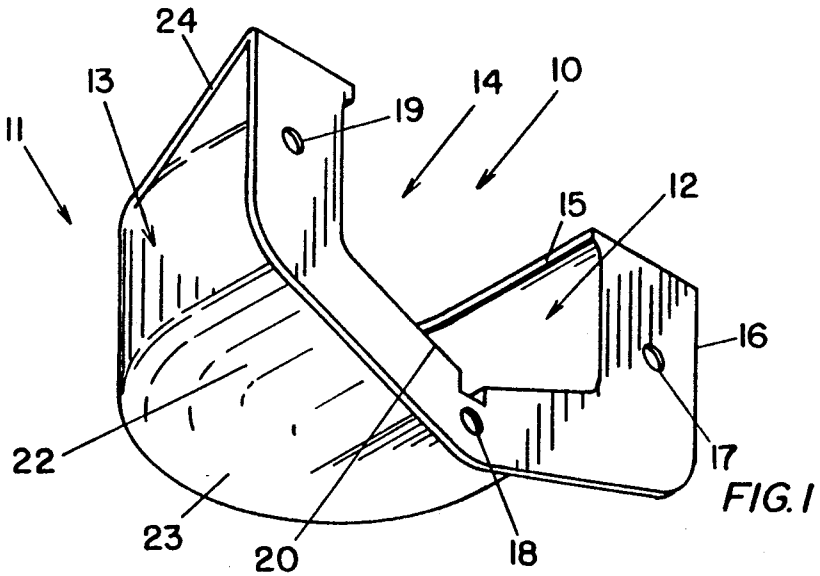
FIG. 1 depicts a pictorial view of the rear, bottom and side portions of the receptacle of the present invention.

FIG. 1 depicts a worm's eye pictorial view of door fixture 10, which is mountable on the visible surface of a door near the unhinged side and bottom thereof, for manipulating the door with the walking appliance of a disabled person. The door fixture comprises a receptacle 11 having a cavity 12 form therein. The receptacle includes an outer wall 13 and an appliance opening 14 in the top portion of the outer wall communicating with the cavity for passing a walking appliance therethrough and into the cavity. Outer wall 13 has a ledge 15 extending toward the cavity and at least partially around appliance opening 14 for engaging a walking appliance when inserted through the appliance opening and into the cavity. A walking appliance such as the tip of a crutch or cane is inserted through appliance opening 14 and into cavity 12. When the fixture is mounted on the visible surface of a door near the unhinged side and bottom thereof, the tip of a crutch or cane cradled in the door fixture can either push or pull the door open or closed. When pulling the door with the fixture mounted thereon, the tip of the crutch or cane is in cavity 12 and engages ledge 15 to prevent the tip from sliding or pulling out of the cavity. Door fixture 10 further includes a flat surfaced flange 16 extending from receptacle 11. The flange with holes 17–19 formed therein is easily mounted to the surface of a door with commercially available fasteners positioned through the flange and door. Door fixture 10 further includes a mold opening 20 in the rear portion of receptacle 11 and flange 16 that communicates with cavity 12 and appliance opening 14. Mold opening 20 simplifies and significantly reduces the cost of well-known injection molding door fixture 10 using for example commercially available ABS (acrylonitrile, butadiene and styrene) plastic material.

Figure 2:
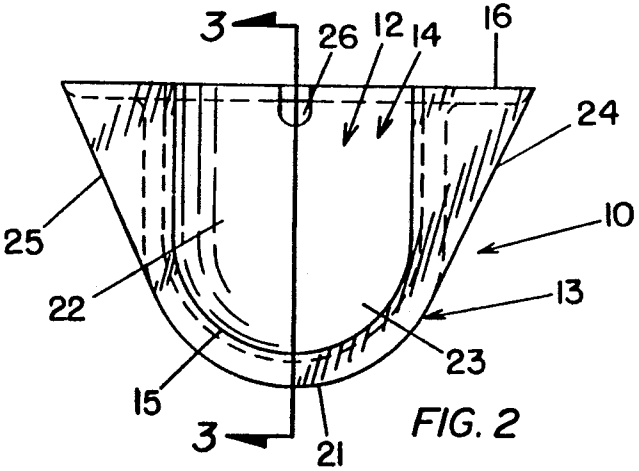
FIG. 2 depicts a top view of the receptacle of FIG. 1.

FIG. 2 depicts a top view of door fixture 10 of FIG. 1. Outer wall 13 includes a rounded or U-shaped front portion 21 extending to the rear of the receptacle and flange 16. Appliance opening 14 extends through the top portion of the outer wall and communicates with cavity 12. The bottom of the receptacle is formed by V-shaped bottom portion 22 of outer wall 13 and a partial conically-shaped portion 23 extending from the U-shaped front portion and V-shaped bottom portion of the outer wall. Reinforcing members 24 and 25 extend from about the top portion of the outer wall between the U-shaped front portion and flange 16. Ledge 15 extends about the top of the U-shaped outer wall to engage a crutch or cane tip when positioned through appliance opening 14 and in cavity 12. V-shaped bottom portion 22 includes a drain hole 26 extending therethrough near flange 16 for allowing fluids such as rain water to drain from the door fixture when mounted to the surface of a door. The drain hole prevents the door from deteriorating due to the presence of water, as well as preventing the crutch or cane tip from becoming wet and susceptible to slippage.

Figure 3:
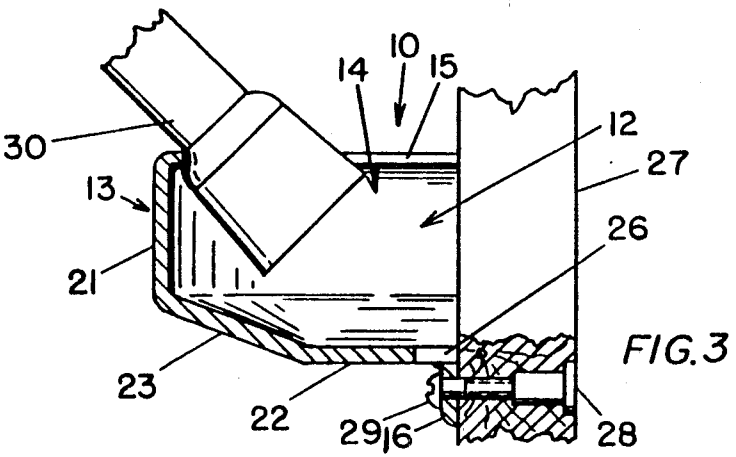
FIG. 3 depicts a partially sectioned side view of the receptacle of FIG. 2 along the line 3—3 with the tip of a walking appliance engaging the ledge of the outer wall.

FIG. 3 depicts a partially sectioned side view of door fixture 10 taken along the line 3—3 of FIG. 2. Door fixture 10 has been mounted on door 27 using commercially available threaded cap sleeves 28 and bolt 29 extending through the thickness of the door and flange 16. Crutch or cane tip 30 is shown positioned in cavity 12 engaging ledge 15, extending about appliance opening 14. The crutch tip is pulled against ledge 15 to manipulate the door to, for example, a closed position. Alternatively, the crutch tip can be positioned against the door to push the door either open or closed. Partial conically shaped portion 23 is depicted extending between V-shaped bottom portion 22 and U-shaped front portion 21 of outer wall 13. Drain hole 26 extends through V-shaped bottom portion 22 near flange 16. The drain hole is formed during the injection molding process at the rear of the door fixture to permit the formation thereof without having to drill a separate hole therethrough. Although depicted as being attached to the flat surface of the door with flange 16, the door fixture can be closed about the rear portion of the receptacle with a flat surface for attachment through the rear portion of the receptacle to a door.

Figure 4:
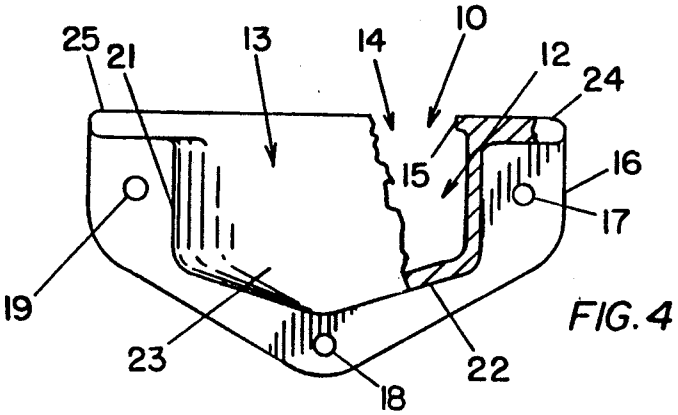
FIG. 4 depicts a partially sectioned front view of the receptacle of the door fixture of FIG. 1.

Depicted in FIG. 4 is a partially sectioned front view of door fixture 10. Rounded or U-shaped front portion 21 of outer wall 13 is partially sectioned to show partial conically-shaped bottom portion 23 and V-shaped bottom portion 22. Ledge 15 positioned about the top of the outer wall extends about appliance opening 14 and towards or into cavity 12. Reinforcing members 24 and 25 extend between the top of U-shaped front portion 21 and mounting flange 16. Door fixture 10 is formed from any of a number of commercially available materials such as ABS plastic material or cast aluminum. Other metals alloys or plastic materials are also suitable. The door fixture is preferably injection molded with a die extending through mold opening 12. This minimizes the necessity for any further machining or clean up work. Viewing door fixture 10 in FIG. 4, the width of flange 16 is approximately 4.26 inches with an overall height of 2.5 inches. The bottom of the flange is V-shaped with the edges extending at approximately 30 degrees with respect to a horizontal line. The depth of cavity 12 ranges from a minimum of 1.38 inches about the U-shaped front portion of the outer wall to a maximum of 1.75 inches from the top surface of the receptacle to the bottom of the V-shaped portion. The V-shaped bottom portion has an included angle of approximately 120 degrees about the center line of the cavity. Ledge 15 extends about the top portion of the outer wall with a thickness of approximately 130 inches in height and width. The thickness of all walls, reinforcing members and the mounting flange is approximately 0.130 inches. The width and depth of the cavity 12 as viewed in FIG. 2 is approximately 2.76 inches with the U-shaped front portion having an inside radius of approximately 1.25 inches. Mounting holes 17 and 19 in flange 16 are approximately 0.75 inches from the top of the fixture. Mounting hole 18 is positioned about the center of the fixture, approximately 2.125 inches from the top thereof. Mounting holes 17 and 19 are also positioned typically 1.750 inches from the center line of the cavity.

The method of manipulating a door with a walking appliance of a disabled person includes providing a door fixture positioned on the visible surface of a door near the unhinged side at bottom thereof. The door fixture includes a receptacle as previously described with an appliance opening in the outer wall communicating with a cavity thereof for passage of the walking appliance through the appliance opening and into the cavity. The method further includes positioning the walking appliance through the appliance opening and into the cavity of the door fixture and moving the door with the walking appliance when positioned in the cavity. The method further comprises the steps of providing the door fixture with a ledge extending at least partially about the appliance opening and toward the cavity for engagement of the walking appliance thereagainst position through the appliance opening and in the cavity. The tip of the walking appliance engages the ledge when positioned through the appliance opening and in the cavity for manipulating the door. The step of moving the door includes engaging the walking appliance against the ledge when the door is pulled with the walking appliance.

It is to be understood that the above-described fixture for manipulating a door with a walking appliance is merely an illustrative embodiment of the principles of this invention and that numerous other fixtures may be devised by those skilled in the art, without departing from the spirit and scope of the invention. In particular, the preferred embodiment of the invention has been described as mounted on the visible surface of a door near the bottom and unhinged side thereof. However, the fixture may be fashioned for mounting into a cavity formed at the bottom of the door. Furthermore, the size and shape of the door fixture can be varied to accommodate different size walking appliances utilized by a particular disabled person. The fixture can also comprise an enclosed receptacle with but a single appliance opening formed therein. Only one of the surfaces of the outer wall need be flat for mounting on a door.

What is claimed is:

1. A walking appliance fixture arranged to be mounted on an outer surface of a door to facilitate operation of the door by a walking appliance, said fixture comprising a receptacle formed to receive the end of the walking appliance, said receptacle comprising:

an elongated cavity for receiving said end of said walking appliance and having first dimensions in directions substantially parallel said surface and a second dimension in a direction extending outwardly from said surface, said second dimension having a greater magnitude than said first dimensions;

an outer wall surrounding said cavity; and an appliance opening in said outer wall communicating with said cavity to allow passage of said end of said walking appliance into said cavity;

a portion of said outer wall forming a ledge projecting inwardly towards said cavity and extending at least partially about said appliance opening for maintaining said end of said walking appliance in said receptacle when said end of said walking appliance is positioned in said cavity.

2. The fixture of claim 1 wherein said receptacle includes a surface for attachment of said receptacle to a door.

3. The fixture of claim 1 further comprising a flange extending from said outer wall for attachment of said receptacle to a door.

4. The fixture of claim 3 wherein at least one of said outer wall and said flange includes a mold opening therein communicating with said appliance opening and said cavity.

5. The fixture of claim 3 further comprising a reinforcing member extending between said outer wall and said flange.

6. The fixture of claim 1 wherein said outer wall includes a rounded portion.

7. The fixture of claim 5 wherein said outer wall includes a V-shaped portion.

8. The fixture of claim 7 wherein said outer wall includes at least a partially conical portion communicating with said V-shaped portion and said rounded portion.

9. The fixture of claim 1 wherein said outer wall includes a drain opening extending therethrough and communicating with said cavity.

10. The fixture of claim 1 wherein said outer wall comprises a plastic material.

11. The fixture of claim 1 wherein said fixture further comprises a flange extending from said outer wall for attachment of said receptacle to a door, a reinforcing member extending between said flange and said outer wall at least partially about said appliance opening, and a mold opening extending through at least one of said outer wall and said flange and communicating with said appliance opening and said cavity, and wherein said outer wall includes a U-shaped front portion, a V-shaped bottom portion communicating with said U-shaped front portion, and partially conical portion communicating with said V-shaped bottom and said U-shaped front portions, said V-shaped bottom portion having a drain opening therethrough.

12. A walking appliance door fixture arranged to be mounted on an outer surface of a door and comprising:

a receptacle having an elongated cavity having first dimensions in directions substantially parallel said outer surface and a second dimension in a direction extending outwardly from said surface, said second dimension having a greater magnitude than said first dimensions, an outer wall, and an appliance opening in said outer wall communicating with said cavity, said receptacle being sized for passage of an end of a walking appliance through said appliance opening and into said cavity, said outer wall having a U-shaped front portion and a ledge projecting inwardly into said cavity and extending at least partially around said appliance opening about said U-shaped front portion for maintaining said walking appliance in said cavity when said end of said walking appliance is positioned in said cavity and against said ledge.

13. The fixture of claim 12 further comprising a flat-surfaced flange extending outwardly from said outer wall for attachment of said fixture to a door.

14. The fixture of claim 13 wherein said outer wall has at least a partially conical portion extending from said U-shaped front portion and a V-shaped bottom portion.

15. The fixture of claim 14 wherein said V-shaped bottom portion of said outer wall has a drain hole therein.

16. The fixture of claim 12 wherein said outer wall comprises a V-shaped bottom portion, said fixture further comprising a flat-surfaced flange extending outwardly from said U-shaped front portion and said V-shaped bottom portion for mounting said fixture on a door surface.

17. The fixture of claim 16 wherein said flange has a mold opening therein communicating with said cavity and said appliance opening.

18. The fixture in accordance with claim 1 wherein said cavity extends in a direction substantially perpendicular to said surface.

19. A walking appliance fixture arranged to be mounted on an outer surface of a door and comprising:

a receptacle having an elongated cavity having first dimensions in directions substantially parallel said outer surface and a second dimension in a direction extending outwardly from said surface, said second dimension having a greater magnitude than said first dimensions, an outer wall, and an appliance opening in said outer wall communicating with said cavity, said receptacle being sized for passage of an end of a walking appliance through said appliance opening and into said cavity, said outer wall having a ledge projecting inwardly toward said cavity and extending at least partially about said appliance opening for maintaining said walking appliance in said cavity when said end of said walking appliance is positioned in said cavity and against said ledge.

20. A method of manipulating a door with a walking appliance of a disabled person, comprising the steps of:

providing a door fixture positioned on a visible surface of a door near the unhinged side and bottom thereof, said fixture having a receptacle with an elongated cavity having first dimensions in directions substantially parallel said surface and a second dimension in a direction extending outwardly from said surface, said second dimension having a greater magnitude than said first dimensions, an outer wall having a ledge projecting inwardly toward said cavity, and an appliance opening in said outer wall communicating with said cavity for passage of an end of said walking appliance through said appliance opening and into said cavity;

positioning said walking appliance through said appliance opening and into said cavity of said door fixture; and moving said door with said walking appliance when said end of said walking appliance is positioned in said cavity.

21. The method of claim 20 wherein the step of moving said door includes maintaining said end of said walking appliance against said ledge when said door is pulled with said walking appliance.

* * * * *